United States Patent [19]

Caravias

[11] 4,148,264

[45] Apr. 10, 1979

[54] TABLE HAVING MULTIPLE TABLE TOP ELEVATIONS

[76] Inventor: Diomedes Caravias, 8821 SE 72nd, Mercer Island, Wash. 98040

[21] Appl. No.: 901,702

[22] Filed: May 1, 1978

Related U.S. Application Data

[63] Continuation-in-part of Ser. No. 804,535, Jun. 8, 1977, abandoned.

[51] Int. Cl.[2] ..... A47B 9/00; F47B 85/00; A47B 1/04

[52] U.S. Cl. ..... 108/145; 108/12; 108/69; 108/83

[58] Field of Search ..... 108/144, 145, 160, 106, 108/88, 64, 81, 83, 69, 77, 83, 80, 90, 12, 76; 248/188.6, 166

[56] References Cited

U.S. PATENT DOCUMENTS

| | | | |
|---|---|---|---|
| 1,951,594 | 3/1934 | Carrol | 108/130 |
| 2,035,718 | 3/1936 | Perl | 108/80 |
| 2,187,423 | 1/1940 | Hyland | 108/77 |
| 2,544,229 | 3/1951 | Hoppe | 108/145 |
| 2,596,986 | 5/1952 | Curtis | 108/144 X |
| 2,799,544 | 7/1957 | Hoppe | 108/145 |
| 3,282,566 | 11/1960 | Clarke | 108/144 X |
| 3,455,256 | 7/1969 | Prager | 108/144 X |
| 3,510,129 | 5/1970 | Reuther | 108/144 |
| 3,688,705 | 9/1972 | Barabas | 108/145 |

FOREIGN PATENT DOCUMENTS

| | | | |
|---|---|---|---|
| 1129818 | 9/1956 | France | 108/12 |

*Primary Examiner*—James T. McCall

[57] ABSTRACT

A universal table having utility at different elevations which includes a top, leg means and brace means. The pair of leg means are pivotally mounted to the top and to a secondary member located vertically downwardly from the pivotal connection to the top. Each pair of leg means extends angularly upwardly and inwardly to the point of connection with the top and has pivotally secured thereto, at a point intermediate the ends, a brace means which extends upwardly and outwardly and has its upper end portion pivotally connected to the table top. The brace means may alternatively be composed of two aligned pivotaly connected brace means or a pair of telescopically interconnected members such that when a table is in a lower position, the brace members are in a semi-folded condition or telescoped. In the upright position, the pivotable brace members are aligned and the telescopic brace members would be extended to their maximum. The table top is formed of two halves which are relatively movable, toward each other as the upper portion of the legs move toward each other and away from each other, to have the space therebetween to be occupied by a separate member when the table is in its uppermost position, and the uppermost ends of the legs are separated by a greater distance.

12 Claims, 20 Drawing Figures

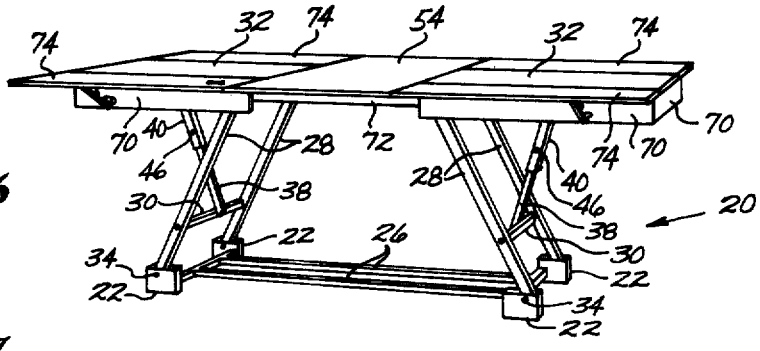
Fig. 6
Fig. 7
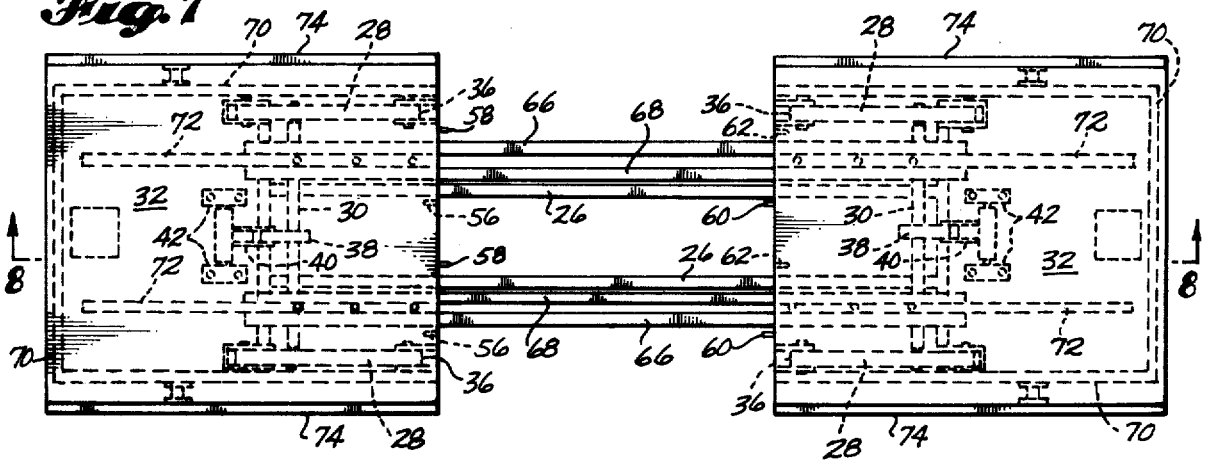
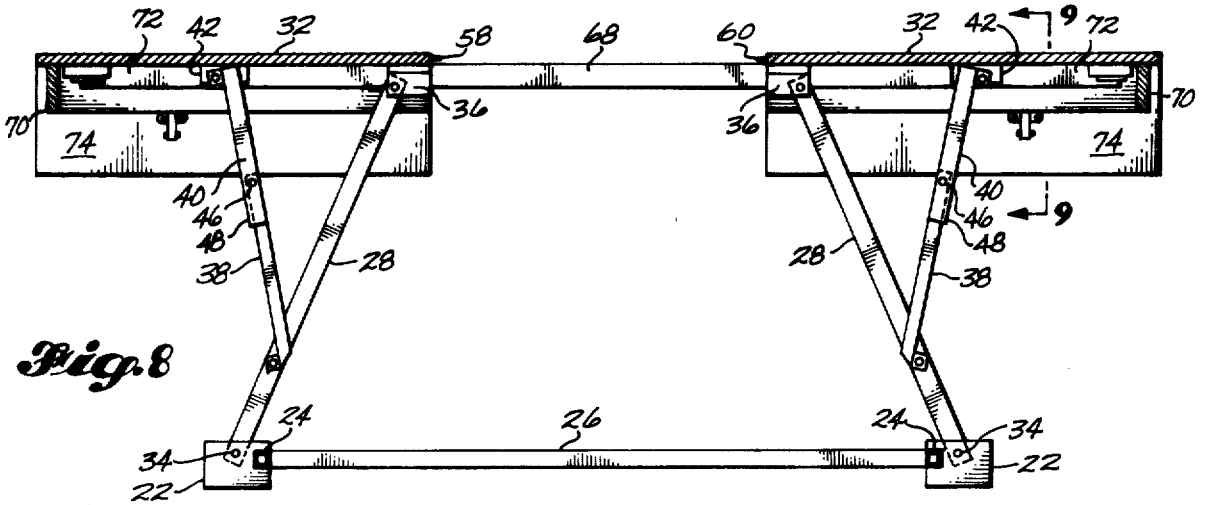
Fig. 8
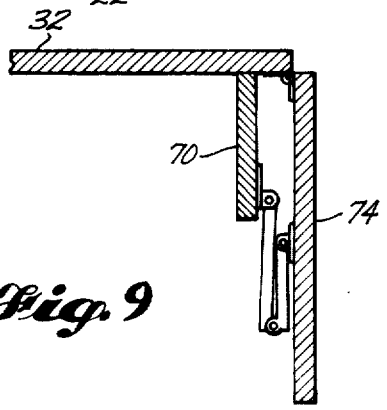
Fig. 9
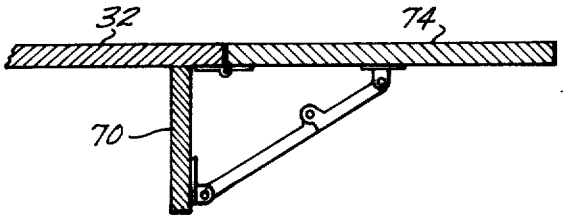
Fig. 10

TABLE HAVING MULTIPLE TABLE TOP ELEVATIONS

The present application is a continuation-in-part of U.S. application Ser. No. 804,535 filed in June 8, 1977, now abandoned.

BACKGROUND OF THE INVENTION

The present invention deals with a multiple use table. It is extremely important to people living in small apartments or operating on a limited budget to have furniture that is capable of being used for more than one particular purpose and further having a plurality of configurations. The present invention contemplates a table which satisfies these needs. By a simple operation, the table is converted from a coffee table to a work or dining table at full height. The table is attractive and thus can be utilized for a multiplicity of purposes in diverse settings.

Prior art known to the inventor which deal with multiple use tables include U.S. Pat. No. 1,951,594 granted to Carroll on Mar. 20, 1934, which discloses a collapsing table having pivoting support arms for the legs as well as means for providing additional work surface.

U.S. Pat. No. 2,035,718 granted to Perl on Mar. 31, 1936 deals with a folding table having dropleafs which are supported by brace members interlocking with the folding legs. The legs are designed to maintain the same height of the table whether the leafs are collapsed or extended.

U.S. Pat. No. 2,187,423 granted to Hyland on Jan. 16, 1940 deals with a complex system for supporting a drop leaf extension table top.

U.S. Pat. No. 2,544,229 granted to Hoppe on Mar. 6, 1951 teaches the concept of a vertically adjustable table wherein the main support legs are collapsed against the top to reduce the height of the table. The size of the table top remains constant in both the upper and lower positions.

U.S. Pat. No. 2,799,544 granted to Hoppe July 16, 1957 deals with another form of an adjustable table construction wherein the table legs are moved to a more triangular position to add support to the table when the leafs are extended. The table height does change to a slight degree in this procedure but this is neither the purpose nor the intent of the movement of the table legs.

U.S. Pat. No. 3,688,705 granted to Barabas on Sep. 5, 1972 teaches the concept of a convertible table wherein the top table may be enlarged and the table top raised or lowered by a pair of legs which are capable of being folded.

French Pat. No. 1,129,818 published Jan. 1957 in the name of Lappai deals with a table having different sizes and elevations created by interchangeable and replaceable legs.

With the exception of the above, in addition to a standard high/low table which appear on small pleasure craft, which include a pair of telescopically interconnected legs having pins or threaded stopper means to place the table top at the appropriate height, there are no known combination height tables constructed and/or designed with any where near the versatility or the mechanism as appears in the present invention. The unique construction of the support in the present table including the legs and the braces permits rapid and easy interchange between a high standard top table and a low coffee table and further permits the mechanism to be utilized in an attractive table.

SUMMARY OF THE INVENTION

The present invention deals with a multiple use multiple configuration table wherein opposing pairs of legs are pivotally mounted to the table top and further pivotally mounted to a fixed member separating the legs either at their base portion or at a point intermediate their base and the pivotal connection with the top. As the table is moved from its lower or coffee table position to its upper or standard position the legs which are angled towards each other when in the lower position must move to a more vertical orientation thus separating the two halves of the table top and permitting the placement of a spacer board therebetween. Since the interconnection between the upper portion of the legs and the table top is close to the center of the table there is provided an outwardly angularly placed brace from the leg members to the top member assuring stability. The particular arrangement of the leg means, brace means and the top with the interconnected rigid members are such that the table presents an attractive appearance and has unusual stability in both its upper and its lower positions.

With the above noted prior art and inadequacies in mind, it is an object of the present invention to provide a unique table configuration which is both attractive and versatile.

It is another object of the present invention to provide a unique table which can be quickly and easily converted from a lower coffee table configuration to an upper standard table configuration and the interrelationship of the parts is such that when the table assumes its upright or standard table position the table top is larger and yet remains well supported.

It is yet another object of the present invention to provide a table wherein the support mechanism for the table is of a unique configuration and because of the triangular interrelationships of the legs, braces and the like the table has unexpected stability.

It is yet another object of the present invention to provide a multi-level table configuration wherein a pair of braces extending from the leg members to the table top supports the table top in a rigid configuration whether the table is upright or in its lower position. When the table is in its upright condition, the brace member is locked in a rigid approximately linear condition and when the table is in a lowered position the brace member is bent and the portion of the brace closest to the table top lies in a position contiguous with the table top as supported by the lower half of the brace member.

Yet another object of the present invention is to provide a multi-level configuration wherein the brace member from the angled legs to the table top includes a pair of telescopically interconnected members which are locked in position when the table is in a lower or coffee table condition and also locked in position when the table is in an upright standard table position.

The foregoing and other objects and advantages of this invention will become implicit and explicit in the description of the invention as it proceeds in connection with the accompanying specification and drawings.

DESCRIPTION OF THE DRAWINGS

FIG. 6 is a perspective view of the table with the table top at the upper or standard elevation and with the center table leaf in position.

FIG. 7 is a plan view, on a larger scale, of the structure of FIG. 6 and with the center table leaf removed.

FIG. 8 is a sectional view taken substantially along line 8—8 of FIG. 7.

FIG. 9 is a fragmentary sectional view taken substantially along line 9—9 of FIG. 8.

FIG. 10 is a view similar to FIG. 9 with the side drop leaf in its lowered position, i.e. the position in which it is shown in FIG. 9.

DESCRIPTION OF PREFERRED EMBODIMENT

Figure 1:
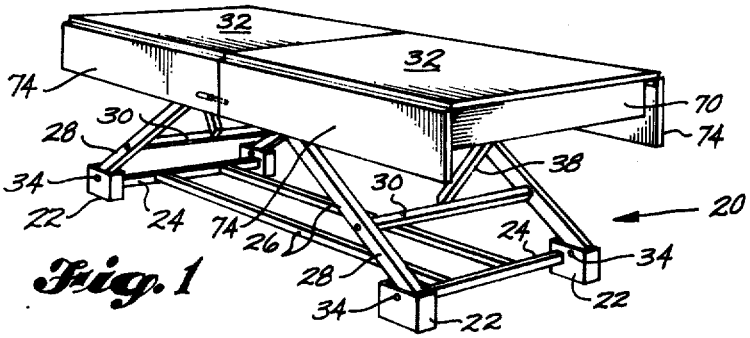
FIG. 1 is a perspective view of the table when the top is supported at coffee table elevation.
Figure 2:
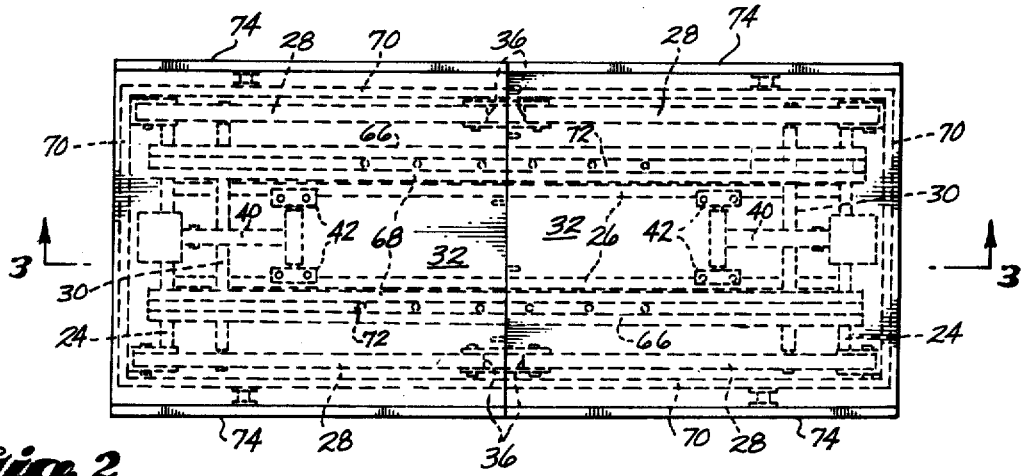
FIG. 2 is a view on a larger scale showing the structure of FIG. 1 in plan.

The table is provided with any suitable base 20, which, as shown in the embodiment of FIG. 1, may take the form of supports 22 resting on a floor and held in spaced relation by cross rods 24 and runners 26. A pair of leg members, including substantially parallel individual legs 28, is disposed at each end of the table. The two legs which form each leg member are joined by a cross brace 30. Each leg 28 extends diagonally upwardly from the support toward and inwardly of the tabletop 32, the latter being composed of two separate units capable of relative lateral movement. Each leg 28 is pivotally connected by a pin 34 with the base 20, as through a support 22. The upper end of each leg 28 is pivotally connected to a support 36, one of which is secured to each side of each of the table top units 32.

A brace means, including a lower brace portion 38 and an upper brace portion 40, is pivotally connected with a pair of legs 28 forming a leg member through cross brace 30 which is located at an elevation intermediate the ends of the legs 28. A separate brace could be provided for each leg if this were desired. The upper end of each upper brace portion 40 is pivotally connected with the underside of each tabletop unit 32.

The preferred interconnection is by a rod means 42 (see FIGS. 3 and 4), carried by brace portion 40, and pivotally mounted by pivot supports 44 mounted to the underside of each tabletop unit 32. Each brace means 38, 40 (in its extended position) extends upwardly and outwardly of a tabletop unit 32 and pivotally connects with a tabletop unit 32 at a location outwardly spaced from that at which the upper ends of the legs 28 connected to such tabletop unit.

Each of the brace portions 38 and 40 is pivotally interconnected by a hinge pin 46 carried by one of said brace portions. Brace portion 38 or 40 has a U-shaped bracket 48, illustrated as part of 40, of a size to encompass the other brace member and this particular structure limits relative turning movement between the two brace portions 38 and 40 to approximately a straight angle of 180°. Thus, when the two brace portions 38 and 40 assume the position shown in FIG. 8 or are substantially axially aligned, further movement past the straight line position is inhibited. Also, the U-shaped bracket 48 can snugly interfit with the brace portion 38 and result in frictional resistance which prevent inadvertent relative turning movement about hinge pin 46. Further, if movement just past a straight angle is permitted, the weight of the tabletop and anything thereon tends to prevent relative angular movement between brace portions 38 and 40.

Figure 3:
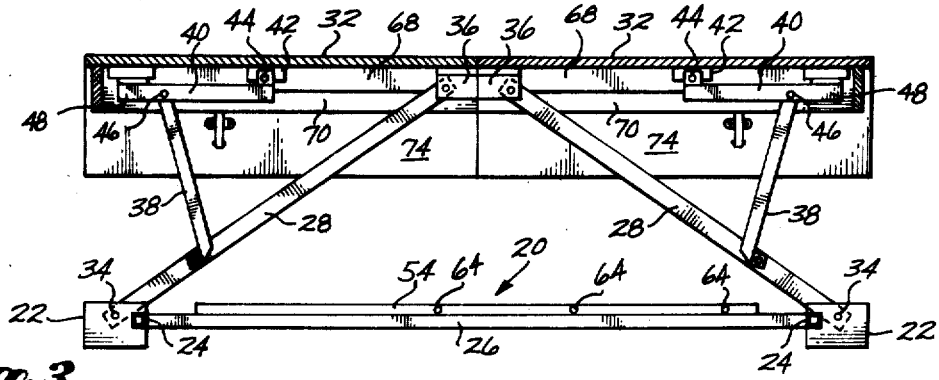
FIG. 3 is a sectional view part shown in elevation and taken substantially on broken line 3—3 of FIG. 2.
Figure 4:
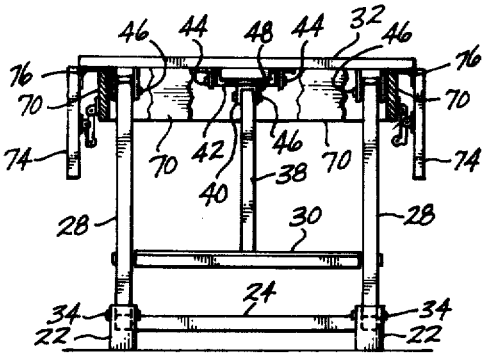
FIG. 4 is an end elevation.
Figure 5:
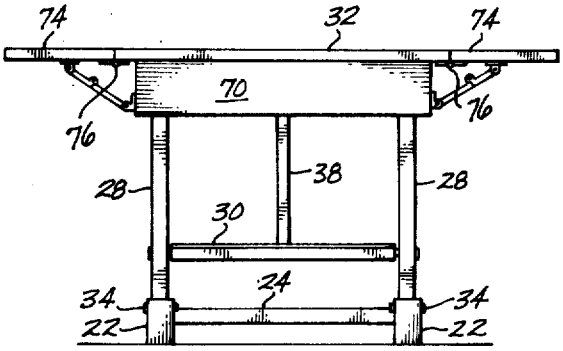
FIG. 5 is a view similar to FIG. 4 with the top leafs on the sides of the table shown in elevated position.

When brace portions 38 and 40 are aligned and the leg members are in a more vertical placement (see, for example FIG. 8), the tabletop 32 is supported at conventional table height and the tabletop units 32 are separated as shown in FIGS. 7 and 8. When each upper brace portion 40 lies parallel to the bottom of a tabletop unit 32 and each lower brace portion 38 (see for example FIG. 3) supports directly between the length of a leg 28 (through cross brace 30) and the underside of a tabletop unit 32 (through the upper brace portion 40 lying parallel to, and connected with, the underside of such tabletop unit), the tabletop 32 is supported at coffee table height and there is no space between the tabletop unit 32 as shown in FIG. 3. Preferably, the brace portions 38 are longer than the brace portions 40 and the brace portions 40 are of a length substantially equal to the desired difference in elevation between that of a coffee table and an ordinary height table.

Referring now to the structure with the parts in the positions as shown in FIGS. 1 to 5 (coffee table elevation and hereinafter further called, lower tabletop position), the tabletop units 32 are together and each upper brace portion 40 is parallel and contiguous with the bottom of a tabletop unit 32 and each lower brace portion 38 extends diagonally downwardly and inwardly toward and connected with a pair of legs 28 through a cross brace 30. As the upper ends of the legs swing upwardly and outwardly about pins 34, the hinge pin 46 (between brace portions 38 and 40) swings downwardly and inwardly and at the same time the tabletop units 32 separate. The selective motion continues until the parts assume the position shown in FIGS. 7 and 8 (ordinary tabletop elevation and hereinafter called; higher tabletop position). At the upper position, the tabletop units 32 are separated and the brace portions 38 and 40 are disposed in substantially axial alignment or in substantially a straight line, and the tabletop units 32 are at higher tabletop position. Also, the hinge pin 46 has moved slightly past center to ensure against accidental movement of the brace about the hinge pin 46.

When the tabletop units are at the higher tabletop position, the center leaf 54 may be inserted in place as shown in FIG. 6. As is true with conventional tables accepting leaves, one tabletop unit 32 carries holes 56 and pins 58 in the side edge portion to match the pins 60 and holes 62 in the side edge of the other unit 32. The center leaf 54 carries holes 64 in its side edges to match the pins 58 in the edges of the tabletop units 32 abutting the edges of the center leaf 54.

A pair of table extension rails 66 and 68 (see FIG. 7) are disposed on each side of the center of the table with one end thereof connected to the underside of the tabletop unit 32 and slidable relative to the other tabletop unit 32 and with the other rail connected with the underside of the other tabletop unit 32 and slidable relative to the said one tabletop unit 32. Thus, the center leaf 54 may be supported vertically by such rails 66 and 68 and be restrained against longitudinal movement by pins 58 and 60 of the tabletop units 32 registering with the holes 64 in the center leaf 54. Also, center leaf 54 carries holes and no pins and thus is not subject to pin breakage or damage when being handled or stored. The storage position of the center leaf 54 if shown in FIG. 2 where it is supported by base 20. Each tabletop unit 32 is further braced by skirts 70 and runners 72 secured to the underside thereof.

The edges of the tabletop unit 32 are preferably provided with drop leaves 74 and hinges 76 connected between the side skirts 70 and the underside of the drop leaves 74. The center hinge pins 78 of the hinges 76 are movable upwardly and inwardly to support the drop leaves 74 in horizontal positions and outwardly and downwardly to position the drop leaves in vertical positions. Again, the hinges 76 have one member thereof, at the center, encompassing the other so that the angular movement is limited to just past the straight angle. Thus, the weight tends to prevent angular movement of the hinge parts to substantially a straight angle and the weight of the leaf is employed to maintain the drop leaves in horizontal planes.

Figure 12:
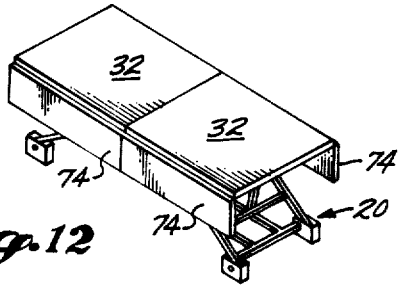
FIG. 12 is a perspective view on a smaller scale of the device with the table top at the lower elevation and with the side leafs down.
Figure 13:
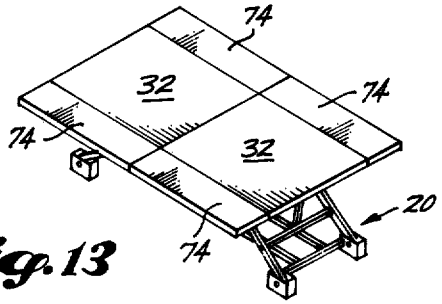
FIG. 13 is a perspective view of the structure of FIG. 12 with the side leafs elevated.

Now referring to FIG. 12, the table is shown at the lower elevation and with the drop leaves 74 dropped or in vertical position. In FIG. 13, the drop leaves 74 have been moved and secured in horizontal positions.

Figure 14:
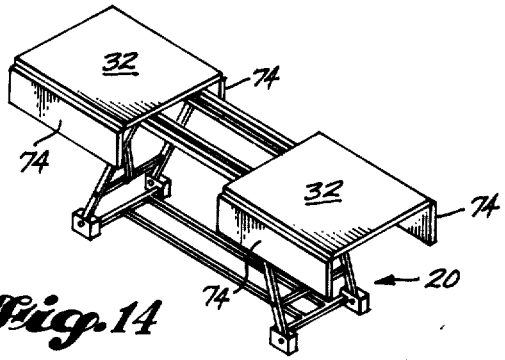
FIG. 14 is a perspective view with the table top at the higher elevation and with the two ends separated leaving a space between the two top portions of the table to receive a supplemental leaf.
Figure 15:
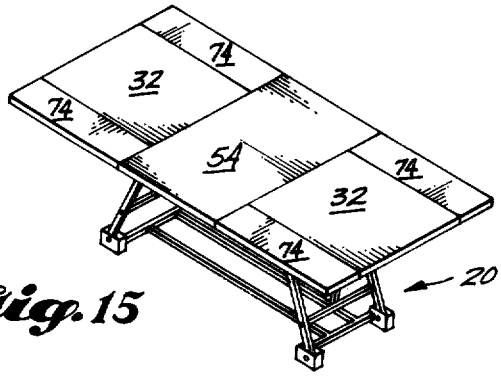
FIG. 15 is a view similar to FIG. 14 but with the side leaf elevated and with the center leaf in position.
Figure 11:
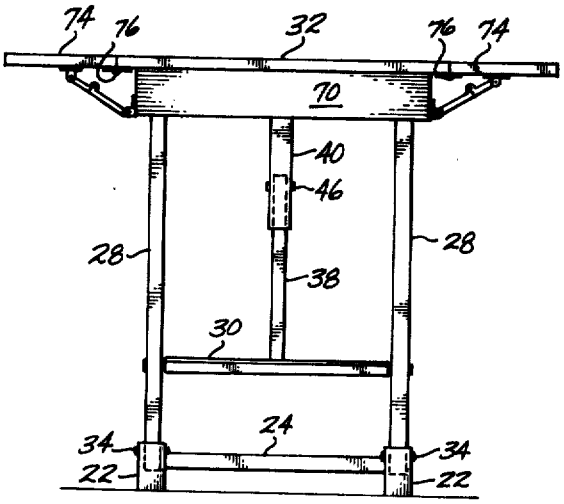
FIG. 11 is an end elevation of the structure of FIG. 8 with the side leafs elevated.
Figure 16:
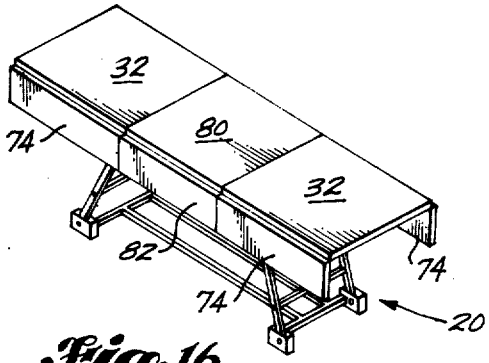
FIG. 16 is a view similar to FIG. 15 showing the utilization of a center leaf having drop leaf end portions.
Figure 17:
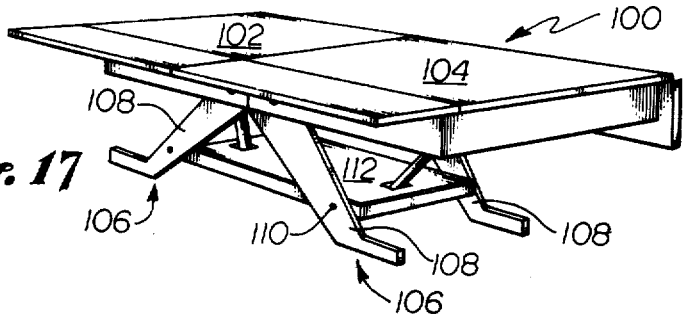
FIG. 17 is a view similar to FIG. 1 showing a second embodiment of the inventive table wherein the rigid brace member is, intermediate the ends of the legs.

In FIG. 14, the brace portions 38 and 40 have been angularly moved and into substantial axial alignment to form substantially a straight angle. At the same time, the tabletop units 32 will move upwardly and away from each other and provide a space into which a center leaf 54 may be placed as shown in FIG. 15. In FIG. 16, the center leaf 54 has been replaced by a center leaf 80 having drop leaves 82 which may be hinged in a manner similar to that of hinged drop leaves 74.

Figure 18:
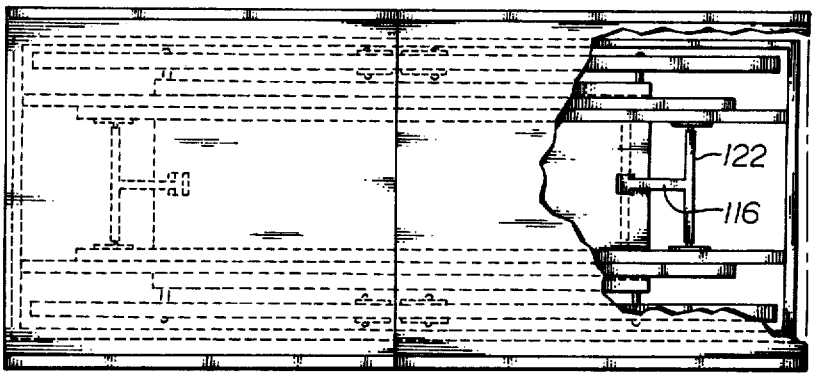
FIG. 18 is a plan view similar to FIG. 2 using the alternate support system.
Figure 19:
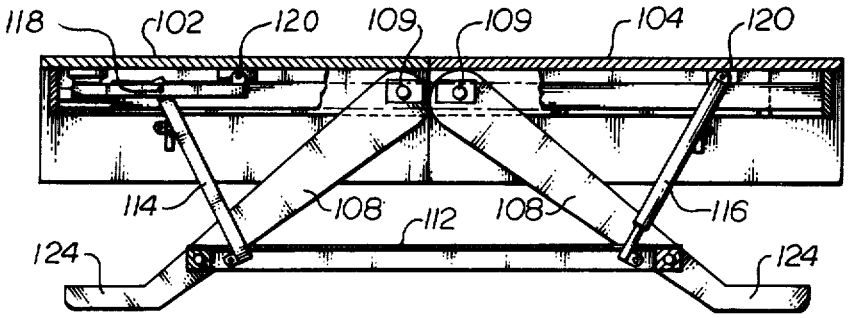
FIG. 19 is a elevational view taken along lines 19—19 of FIG. 18.
Figure 20:
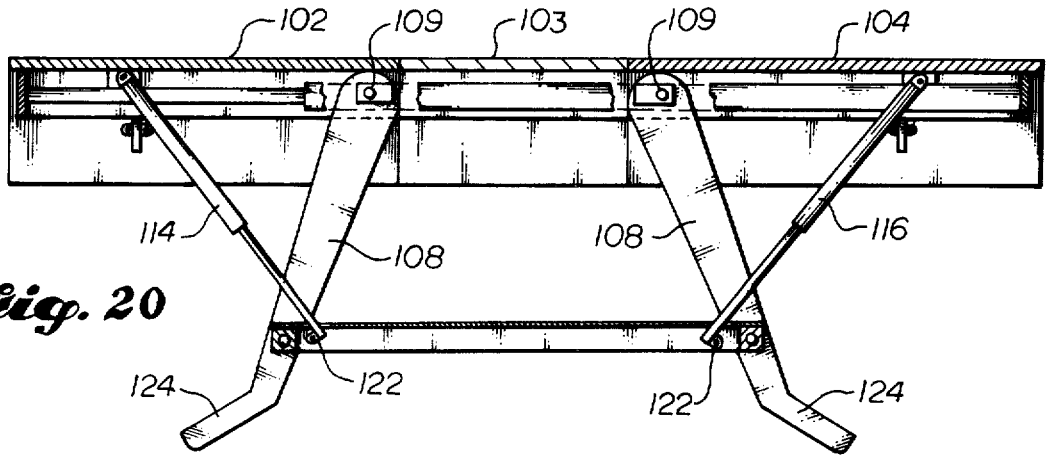
FIG. 20 is an elevation view similar to that of FIG. 19 with the table in its elevated condition.

Referring now in particular to FIGS. 17–20, an alternate embodiment of the table is shown. As seen in these figures, the table has essentially the same characteristics as was illustrated in FIGS. 1–16 and therefore, the details will not be belabored, however, it was felt that it was important to at least illustrate the details so that disclosure would be complete. As seen in these views, the tabletop 100 has two sections 102, 104 which are movable towards and away from each other as was described hereinabove. The leg members 106 each include a pair of leg elements 108 hingedly secured at 110 to a rigid lower shelf 112. As best seen in FIGS. 18 through 20, the table further includes brace members 114, 116. For purposes of illustration, brace member 114 is illustrated as hinged at 118 in a fashion similar to that disclosed hereinabove with respect to the first embodiment. Brace member 116 is alternatively disclosed as being telescoping and includes conventional stop members to hold it rigid at the lowered position as shown in FIG. 19 and in addition to the upper position as seen in FIG. 20. Brace members 114 and 116 are hingedly secured to the tabletop as at 120 and to a linking member 122 which pivotally interconnects a pair of legs 108.

When the table is in its lower position as illustrated in FIG. 19, the foot portion 124 of the leg members 108 sit substantially flat on the supporting surface whereas when the table is moved into its uppermost position as illustrated in FIG. 20, the leg and rigid foot member are caused to pivot and move upwardly such that the foot rests on its outer portion and has a flared configuration at the lower portion.

It is to be noted that when the table is moved from its lower position i.e. FIG. 19 to its upper position i.e. FIG. 20, the hinge points 120 interconnecting the leg 108 to the tabletop sections 102, 104 move from their substantially adjacent position as seen in FIG. 19 to a separate position in FIG. 20 and a leaf 103 is inserted in much a fashion similar to that described hereinabove.

It now should be apparent that a table has been provided wherein the table is quickly and easily movable from a upper standard height condition to a lower coffee table condition and the movement simultaneously changes the size of the table top as well as providing a continuous rigid and adequate support thus assuring a stable piece of furniture at all times. The unique interrelationship of the legs to the top sections, the brace means and the rigid interlinking member between the legs are particularly constructed such that result is both a unique and useful table.

What is claimed is:

1. A stable multipositioned table comprising:

a top member formed of at least two section, said sections supported in a fashion enabling movement away from each other to accept a leaf therebetween, a pair of leg means pivotably secured to the top member to each opposing section and further pivotably secured along an axis parallel the axis of pivot to the top member, to a rigid linking member located below the top the pivot being located at a position horizontally outward from a vertical plane passing through the point of secure-to the table top whereby the table may be utilized in a lower position whereat the sections of the table top are contiguous or in an elevated position by pivoting the legs about their pivot points and moving the bottoms of the legs together whereat the sections of the table top are caused to separate because of the rigid links and the interrelationship between the various parts enabling a larger and higher table once a leaf is inserted between the sections.

2. A table as in claim 1, wherein brace means extend from each leg means to the adjacent section.

3. A table as in claim 2, wherein the brace means is in two sections pivotally secured together assuming an overcenter position when the table is in its raised position and having one section substantially parallel to and contiguous with the top when the table is in its lowered position.

4. A table comprising a base: a tabletop supported at a plurality of locations above said base and comprising two tabletop units movable toward and away from each other, and a removable table leaf disposed between said two units; two spaced apart leg means each pivotally connected at its lower end portion with said base, extending diagonally upwardly and inwardly, and pivotally connected, at its upper end portion, with one of said tabletop units at a first location thereof and two brace means each pivotally connected at a lower end portion thereof, with one of said leg means and at a location intermediate the end portions of said leg means, extending diagonally upwardly and outwardly and pivotally connected with one of the units of the tabletop at a second location outwardly spaced from said first location, said brace means comprising two aligned, pivotally interconnected, brace members.

5. The combination of claim 4, wherein each of the leg means comprises two laterally spaced apart leg members and a cross bar connected therebetween, and the brace means is pivotally connected to the leg means through said cross bar.

6. The combination of claim 4, wherein one of the two aligned, pivotally interconnected brace members of the brace means comprises a U-shaped bracket carried by one brace member and if of a size to encompass the other brace member and a hinge pin interconnects the two brace members.

7. The combination of claim 6, wherein the two brace members are vertically aligned and the uppermost thereof carries said U-shaped bracket.

8. The combination of claim 4, wherein each of the two brace members are vertically aligned and the uppermost thereof is movable into a position below and horizontally aligned with the bottom of a tabletop unit and the lowermost brace member is then disposed in bracing relation between a tabletop unit and a leg means.

9. The combination of claim 4, wherein drop leaf, tabletop members are hingedly connected with the marginal edge portions of the tabletop and are provided with selectively operable braces to hold them in horizontal positions.

10. The combination of claim 4, wherein drop leaf, tabletop members are hingedly connected with the marginal edge portions of the removable table leaf and are provided with selectively operable braces to hold them in horizontal positions.

11. The combination of claim 8, wherein the pivotal connection between the two brace members moves upwardly and outwardly as the uppermost brace moves toward its position of parallel alignment with the bottom of the tabletop.

12. The combination of claim 11, wherein the lowermost brace member extends upwardly and outwardly as the uppermost brace member moves toward its position of alignment with the bottom of the tabletop.

* * * * *